United States Patent [19]

Grable

[11] 4,249,154

[45] Feb. 3, 1981

[54] TEMPERATURE RESPONSIVE ELECTRICAL SWITCHING DEVICE AND METHOD OF CALIBRATING

[75] Inventor: Jack W. Grable, Dayton, Ohio

[73] Assignee: Emerson Electric Co., St. Louis, Mo.

[21] Appl. No.: 11,215

[22] Filed: Feb. 12, 1979

[51] Int. Cl.[3] ..... H01H 37/20

[52] U.S. Cl. ..... 337/360; 29/622; 337/299

[58] Field of Search ..... 337/82, 84, 323, 360, 337/392, 299, 338; 29/622

[56] References Cited

U.S. PATENT DOCUMENTS

| | | | |
|---|---|---|---|
| 3,230,607 | 1/1966 | Gelzer | 337/94 |
| 3,787,793 | 1/1974 | Willson | 337/338 |
| 3,816,910 | 6/1974 | Jess et al. | 29/622 |
| 4,033,029 | 7/1977 | Wolfe | 29/622 |
| 4,047,141 | 9/1977 | Holden | 337/89 |
| 4,090,166 | 5/1978 | Burch | 337/360 |

*Primary Examiner*—William H. Beha, Jr.
*Attorney, Agent, or Firm*—Biebel, French & Nauman

[57] ABSTRACT

A temperature responsive electrical switching device provides an electrical connection between first and second electrical connectors when the temperature of the device is less than a predetermined threshold temperature and terminates the electrical connection when the temperature of the switching device exceeds the predetermined threshold temperature. The device includes a non-conductive mounting post assembly and stationary and movable contact blades mounted thereon. A temperature responsive bimetal blade cooperates with a non-conductive actuator to move the flexible contact blade out of contact with the stationary contact blade when the predetermined threshold temperature is exceeded. The actuator means includes a non-conductive means defining a cavity holding a quantity of resin which engages the flexible contact blade. By placing the switching device in an oven at a selected temperature, the actuator means is moved by the bimetal blade to the desired position for proper calibration. Subsequently the resin is cured and the position of the actuator means thereby fixed with respect to the flexible contact blade. A switching device including two flexible contact blades and two stationary contact blades, with one set of blades actuated at a maximum predetermined temperature threshold and the other set of blades actuated at a minimum predetermined threshold temperature is calibrated in a similar manner.

8 Claims, 11 Drawing Figures

TEMPERATURE RESPONSIVE ELECTRICAL SWITCHING DEVICE AND METHOD OF CALIBRATING

RELATED APPLICATIONS

Attention is directed to U.S. patent application Ser. No. 011,214, filed Feb. 12, 1979, and U.S. patent application Ser. No. 099,133, filed Nov. 29, 1979.

BACKGROUND OF THE INVENTION

The present invention relates to a temperature responsive electrical switching device and to a method of calibrating such a device. More particularly, the present invention relates to an electrical switching device including a bimetal blade which, through an actuator, causes a movable switch contact blade to be moved out of electrical contact with a stationary switch contact blade when the switching device is heated to a temperature exceeding a predetermined threshold temperature.

One type of known prior art temperature responsive electrical switching device includes a bimetal blade having mounted thereon a non-conductive actuator of fixed dimension. The actuator is moved by the bimetal blade into contact with a movable contact blade when a predetermined switch threshold temperature is reached. The movable contact blade is thereafter moved out of electrical contact with a stationary contact blade.

In such prior art switching devices, a non-conductive calibrating screw is threaded through an opening in the switch mounting structure and contacts the stationary contact blade. By rotating the non-conductive calibrating screw, the position of the stationary contact blade may be adjusted slightly. When the switching device is to be calibrated, it is connected electrically to a continuity testing device and placed in an oven which is maintained at a precise predetermined temperature. After being fully heated, the bimetal blade deflects the movable contact blade by means of the non-conductive actuator to a selected position. The adjusting screw is then utilized to move the stationary contact blade until the electrical connection between the movable and stationary contact blades is broken. Thereafter, electrical connection between the stationary and movable contact blades is provided until the predetermined temperature is reached, at which time the non-conductive actuator is moved sufficiently by the bimetal blade to contact the movable blade and move it out of the electrical contact with the stationary contact blade. The adjusting screw is fixed in its adjusted calibrated position by means of an epoxy material which is deposited around the head of the screw and thereafter cured.

It will be appreciated that such a prior art temperature responsive electrical switching device has substantial disadvantages. Manual calibration of each device is required, which may result in a substantial percentage of the switches being inaccurately calibrated. This likelihood of miscalibration is accentuated by the fact that the calibration operation must be performed in an oven. Typically, a small opening is provided in the oven wall through which a screwdriver is inserted to adjust the calibration screw. Additionally, this calibration technique results in a relatively expensive switch due to the labor costs involved.

One approach which has been taken to reduce these difficulties in production and calibration of thermal responsive switching devices which include bimetal switch elements is disclosed in U.S. Pat. No. 3,230,607, issued Jan. 25, 1966, to Gelzer. The Gelzer patent discloses a switch in which a bimetal blade is connected to one of a pair of electrically conductive posts extending through a non-conductive mounting structure. The bimetal blade cooperates with a stationary contact on the other of said pair of posts to provide an electrical circuit between the posts until a predetermined threshold temperature is reached. The posts are potted into the non-conductive mounting structure by means of a thermal curable resin. Uncured resin is deposited in a cavity in the mounting structure and the thermal responsive switch is then placed in an oven. The post bearing the stationary contact is shifted by the bimetal element as the element is heated and deflects. After the post is appropriately positioned by the bimetal element, the heat curable resin is cured, fixing the pair of posts in position in the non-conductive mounting structure. While providing a self-calibrating switch, the Gelzer calibration technique is directly applicable only to a switch structure in which the bimetal blade forms a part of the electrical circuit.

It is seen, therefore, that a need exists for an electrical switching device which is simple in construction and which may be calibrated without the need for manual adjustment of switch parts by a technician.

SUMMARY OF THE INVENTION

An electrical switching device for providing an electrically conductive path between first and second electrical connectors when the switching device is below a predetermined threshold temperature, and for opening the electrically conductive path when the switching device is above the predetermined threshold temperature, includes an electrically non-conductive mounting means. A stationary contact means is mounted on the mounting means and electrically connected to the first electrical connector. A movable contact means is mounted on the mounting means and electrically connected to the second electrical connector. The movable contact means electrically contacts the stationary contact means when the movable contact means is in a first switching position.

A temperature responsive bimetal blade is mounted on the mounting means on the side of the stationary contact means opposite the movable contact means. An extensible actuator means is interposed between the movable contact means and the bimetal blade and includes a quantity of cured material fixing the dimension of the actuator means in a direction extending between the bimetal blade and the movable contact means. The movement of the bimetal blade which occurs when the predetermined threshold temperature is exceeded, results in the actuator means moving the movable contact means into a second switching position in which it is out of contact with the stationary contact means.

The electrical switching device is calibrated by supplying a quantity of curable material in an uncured state to a cavity defined by the extensible actuator means. The electrical switching device is then heated to a preselected temperature, causing the bimetal blade to be deflected to a predetermined position and the extensible actuator means to be reduced in dimension between the movable contact means and the bimetal blade. The electrical switching device is then maintained at the preselected temperature until after the material is cured. The dimension of the extensible actuator means extending in a direction between the bimetal blade and the movable contact means is therefore fixed at a selected dimension.

Accordingly, it is an object of the present invention to provide a thermal responsive electrical switching device in which a non-conductive actuator transmits the motion of a bimetal blade to a movable switch contact, with the actuator dimension between the bimetal blade and the movable contact being fixed by a quantity of cured material within the actuator; to provide such a switching device in which the material within the actuator engages the movable contact; to provide such a switch in which calibration of the threshold temperature for switch actuation is accomplished without the need for manual adjustment of the position of the switch elements; and to provide such a switch, and calibration method therefor in which an electrical connection is made between switch connectors when the temperature of the switch is less than a predetermined threshold temperature and greater than a second predetermined threshold temperature.

DETAILED DESCRIPTION OF THE PREFERRED EMBODIMENTS

Figure 1:
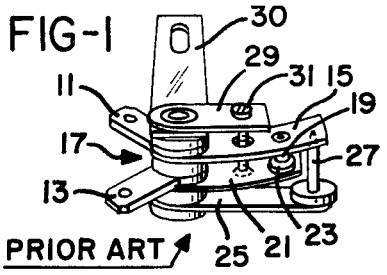
FIG. 1 is a perspective view of a prior art thermal responsive switching device.
Figure 3:
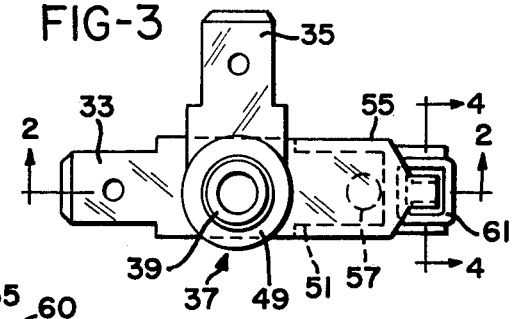
FIG. 3 is a plan view of the switching device of FIG. 2.

The present invention relates to a thermal responsive electrical switching device and, more particularly, to such a device in which calibration is accomplished automatically without the need for manual adjustment of the relative position of the switch elements. FIG. 1 illustrates one type of prior art thermal responsive switching device in which an electrical connection is maintained between electrical connectors 11 and 13 until the temperature of the switch is raised above a predetermined threshold temperature level. A flexible contact blade 15 is mounted on generally non-conductive mounting assembly 17. Blade 15 has mounted thereon a contact 19. Similarly, a stationary contact blade 21 is mounted on the mounting assembly 17. An electrical contact 23 is mounted on stationary blade 21 and electrically contacts contact 19, as shown, when the switch temperature is less than the predetermined threshold temperature.

Blade 15 is electrically connected to connector 11, while blade 21 is electrically connected to connector 13. Thus the current flow path from connector 11 to connector 13 includes blades 15 and 21 and contacts 19 and 23. A bimetal blade element 25 is mounted on the mounting assembly 17 and is electrically isolated from other elements of the switching device. A non-conductive actuator 27 is mounted on the end of bimetal blade element 25.

As the switching device of FIG. 1 is heated, the bimetal element 25 gradually deflects upward until the upper end of actuator 27 contacts movable contact blade 15. Further upward movement of the bimetal element 25 results in the movable contact blade 15 being raised sufficiently such that electrical contact between contacts 19 and 23 is broken. The switch therefore assumes a switching state in which the electrical connection between connectors 11 and 13 is terminated.

Bracket 29, electrically isolated from the other elements of the switching device, receives adjustment screw 31 through a threaded opening. Adjustment screw 31 contacts the stationary contact blade 21. By rotating adjustment screw 31, the stationary contact blade 21 may be deflected slightly downward. Adjustment of the position of stationary contact blade 21 and contact 23 provides a corresponding adjustment in the predetermined threshold temperature which must be exceeded for switch actuation to occur. This is so since the position of contact 23 determines the amount of upward deflection required for the bimetal element 25 before switch actuation occurs. A mounting bracket 30, electrically isolated from other switch elements, provides a means of mounting the switching device.

In order to calibrate the switch of FIG. 1, it is necessary that an electrical continuity detector circuit be connected electrically to connectors 11 and 13 and the switching device of FIG. 1 heated in an oven to the predetermined threshold temperature. After the switch elements have reached the predetermined oven temperature, a technician manually rotates the adjustment screw 31, lowering the position of the stationary blade 21. When the blade 21 has been lowered sufficiently such that the electrical connection between the connectors 11 and 13 is broken, the switch is properly calibrated. The position of the adjustment screw 31 is then fixed by means of an epoxy which is applied to the top of the screw 31 and to bracket 29. As will be appreciated, manual calibration of the switch is an expensive, time consuming operation which is subject to error. The accuracy of this calibration technique is dependent, in large part, upon the skill of the technician in adjusting screw 31.

Reference is now made to FIGS. 2–5 which illustrate one embodiment of the present invention. The normally closed temperature responsive electrical switching device of FIGS. 2–5 provides an electrical connection between a first electrical connector 33 and a second electrical connector 35 when the temperature of the electrical switching device is less than a predetermined threshold temperature. The switching device terminates this electrical connection between connectors 33 and 35 when the temperature of the switching device exceeds the predetermined threshold temperature.

A non-conductive mounting post assembly 37 provides an electrically non-conductive switch mounting means for mounting the respective elements of the switch. Mounting post assembly 37 includes a mounting post rivet 39 which extends through non-conductive sheath 41. Elements of the switch are separated on the mounting post assembly 37 by means of non-conductive spacers 43 and 45. The spacers 43 and 45 and sheath 41 are held between the head 47 of the rivet 39 and washer 49. A stationary electrical contact means includes a first stationary contact blade 51 which is electrically connected to the electrical connector 33. A stationary electrical switch contact 53 is mounted on the stationary contact blade 51.

A movable electrical contact means includes a flexible contact blade 55 which is electrically connected to the second electrical connector 35. A movable electrical switch contact 57 is mounted on the flexible contact blade 55 and electrically contacts the contact 53 when the switching device is in a first switching state, providing electrical connection between connectors 33 and 35.

Figure 5:
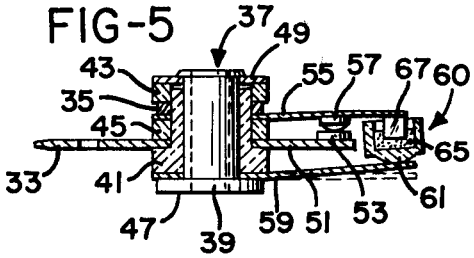
FIG. 5 is a sectional view, similar to FIG. 2, illustrating the manner in which the switching device of the present invention is calibrated.
Figure 6:
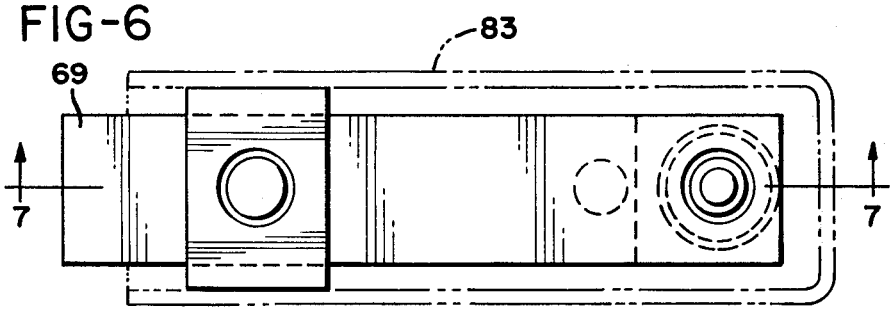
FIG. 6 is a plan view of an alternative embodiment of the switching device of the present invention.

A bimetal means, including temperature responsive bimetal blade 59, is mounted on the mounting assembly 37 on a side of the stationary contact means opposite the movable contact means. An extensible actuator means 60, including a non-conductive means 61 defining a material receiving cavity 63, is interposed between the movable contact means and the bimetal blade 59. A curable material 65, such as a resin, is contained within cavity 63. As used herein, the term curable material is intended to include any material which may be placed in cavity 63 and thereafter solidified. The material may be inserted in cavity 63 in the form of a powder or liquid or, alternatively, in a solid pellet form which may be melted and thereafter cured. As seen in FIG. 5, the extensible actuator means 60 further includes downward extending tabs 67 from the flexible contact blade 55. These tabs 67 are engaged by the resin 65, as generally shown in FIG. 5, such that the flexible contact blade 55 will not be moved upwardly to break the electrical path between connectors 33 and 35 until the bimetal blade 59 has been deflected to a position as illustrated by the solid lines.

Figure 4:
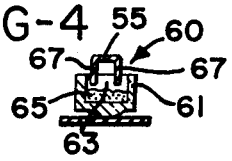
FIG. 4 is a sectional view taken generally along line 4—4 in FIG. 3.
Figure 2:
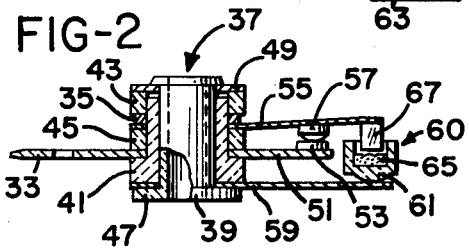
FIG. 2 is a sectional view of a switching device embodying the present invention, taken generally along line 2—2 in FIG. 3.

FIGS. 2 and 4 show the electrical switching device of the present invention prior to calibration. When it is desired to calibrate this switching device, the cavity 63 defined by the actuator means 60, is filled with a quantity of uncured material, such as a resin material. This resin may be a heat curable polymer, such as E31000-4, available from Armstrong Products Co. v. Warsaw, Ind. Alternatively, an enamel material such as GLYPTAL, available from General Electric Corporation, Schenectady, New York, may be utilized as the uncured material. The non-conductive means 61 is placed between the movable contact means and the bimetal blade 59 such that the tabs 67 extend into the cavity 63.

The switching device is then placed in an oven which is heated to a selected temperature, which temperature is slightly less than the predetermined temperature desired for switch actuation. After the switching device has been heated in the oven, the bimetal blade will be deflected into the desired position, as shown in FIG. 5, with respect to the movable contact means. The resin 65 surrounds the tabs 67 and is subsequently cured such that the relative position between the actuator means 60 and the first movable contact means is fixed. The calibration operation is then completed and the switching device may be moved from the oven.

Upon subsequent heating of the switching device to the selected temperature, the bimetal blade 59 will be deflected upward into the position shown in FIG. 5. If the temperature of the switching device is thereafter raised slightly to the predetermined threshold temperature, the bimetal blade 59 will be deflected further upward, thus moving the flexible contact blade 55 such that the electrical contact between contacts 53 and 57 will be broken.

It will be appreciated that the dimension of the actuator means 60, including the resin 65 and tabs 67, in a direction extending between the bimetal blade 59 and the movable contact means is fixed by the position in which the non-conductive means 61 is held during the curing of the resin 65. It is essential, therefore, that the curing time of the resin 65 be of sufficient duration to permit the bimetal blade 59 to be heated to the selected temperature and deflect the non-conductive means 61 to the desired position prior to curing of the resin 65. It will be further appreciated that a different resin may be supplied to the cavity 63 and cured by means other than heating. For example, a resin mixed with a curing catalytic agent may be utilized, provided that the curing time of the resin is less than the time needed for the bimetal blade 59 to deflect fully.

Figure 5A:
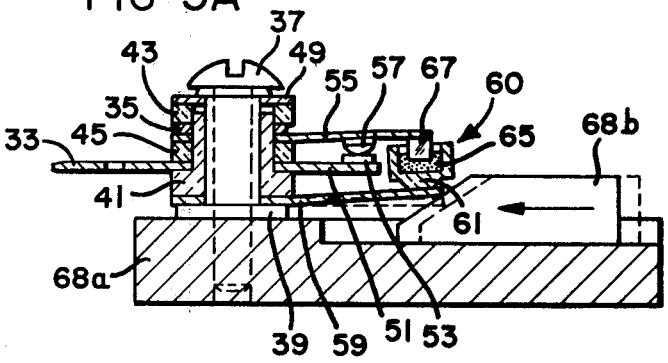
FIG. 5A illustrates an alternative calibration technique.

FIG. 5A shows an alternate method for calibration. The unit to be calibrated is attached to a fixture 68. A wedge 68B is located in the fixture such that when the unit is placed in an oven and the bimetal blade warps, the wedge will slide under the blade and hold it in the calibrated position. The unit is then removed from the oven and allowed to cool.

This method allows the use of certain cements such as "INSOLUTE" made by the Saueriesen Company, Pittsburg, Pa. These materials have outstanding properties at high temperatures but because they cure or set by a drying process they must be cured at temperatures below 200° F.

Reference is now made to FIGS. 6–10 which illustrate an embodiment of the present invention in which an electrical path is provided between electrical connectors 69 and 71 when the temperature of the switching device is less than a predetermined threshold temperature and greater than a second predetermined threshold temperature. A non-conductive mounting post assembly 73 includes non-conductive pin 75 and spacers 77, 79, and 81. The switching device of FIGS. 6–10 is designed to be incorporated within a switch casing 83, illustrated in dashed lines. The non-conductive mounting post assembly 73 is held together by ultrasonically welding spacer 81 to mounting post 75.

A first stationary contact blade 85 is provided, with a first stationary electrical switch contact 87 mounted thereon. A first flexible contact blade 89 is electrically connected to the second electrical connector 71. Blade 89 is mounted on the mounting post assembly 73 and carries a first movable electrical switch contact 91. A first actuator means 93 includes a non-conductive means 95 which defines a material receiving cavity containing curable material 97, such as a resin material. Resin 97 engages the downward turned lip 99 of an opening in the flexible contact blade 89. The actuator means 93 is interposed between the flexible contact blade 89 and bimetal means 101, which is also mounted on the mounting post assembly 73. The bimetal means 101 deflects toward the flexible contact blade 89 in response to heating of the switching device.

Figure 7:
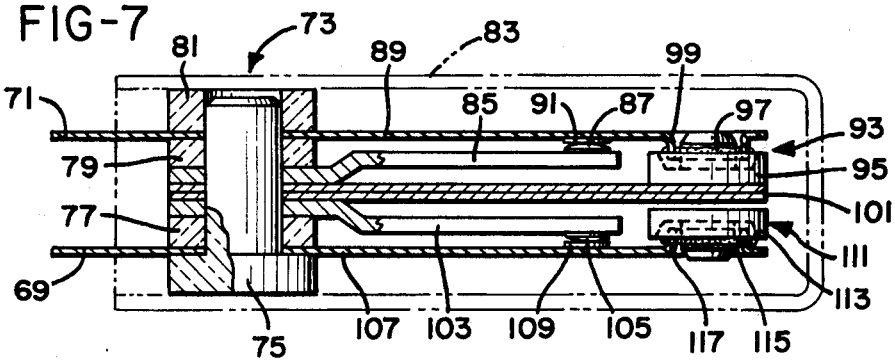
FIG. 7 is a sectional view, taken generally along line 7—7 in FIG. 6.

As with the embodiment described in FIGS. 2–5, the switch of FIG. 7 will terminate electrical contact between connectors 69 and 71 when the temperature of the switch exceeds a predetermined threshold temperature by virtue of the upward movement of the bimetal means 101, which is transmitted to the flexible contact blade 89 by the first actuator means 93.

A second stationary contact blade 103 is electrically connected to the first stationary contact blade 85 through the bimetal means 101 at the mounting post assembly 73. Second stationary electrical switch contact 105 is mounted on the second stationary contact blade 103. A second flexible contact blade 107 is electrically connected to the electrical connector 69. Blade 107 is mounted on the mounting post assembly 73 and has a second movable electrical switch contact 109 mounted thereon. A second actuator means 111 includes a non-conductive means 113 defining a material receiving cavity in which is contained curable material 115, such as a resin. Resin 115 in the cavity of the non-conductive means 113 engages the upward turned lip 117 extending around an opening in the blade 107.

The second actuator means 111 is interposed between the second flexible contact blade 107 and the bimetal means 101 such that downward movement of the bimetal means, upon cooling of the switching device to a temperature below the second predetermined threshold temperature, results in contact between the bimetal blade 101 and the second actuator means 111. The second movable electrical contact 109 is thereby moved out of the electrical contact with the second stationary electrical contact 105 and this results in termination of the electrical connection between electrical connectors 69 and 71. It should be noted that, as illustrated in FIG. 7, a gap exists between the bottom of the bimetal blade 101 and the top of the non-conductive means 113. Since the position of the switch elements in FIG. 7 is such as would occur with the switching device heated to a temperature just slightly below the upper predetermined threshold temperature, the width of the gap between the bimetal blade 101 and the non-conductive means 113 corresponds to the temperature differential between the upper predetermined threshold temperature and the second lower predetermined threshold temperature. In order to terminate the electrical connection between connectors 69 and 71 by opening contacts 105 and 109, the switching device must be cooled sufficiently such that the bimetal blade 101 deflects downward into contact with the non-conductive means 113. Therefore, by adjusting the gap dimension between the non-conductive means 113 and the bimetal blade 101, the second lower predetermined threshold temperature is determined.

Figure 8:
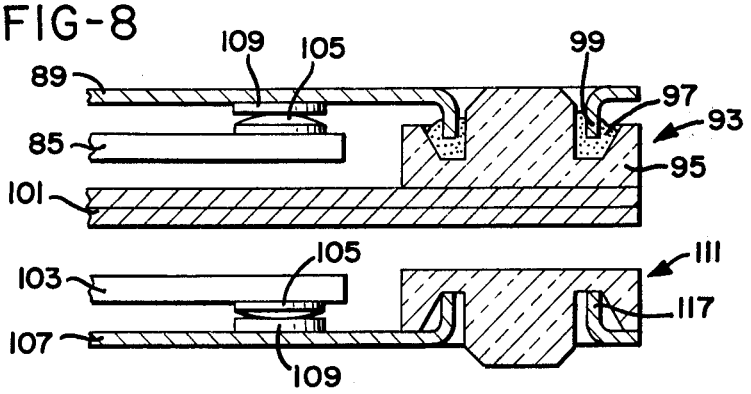
FIG. 8 is an enlarged fragmentary sectional view of a portion of the switching device of claim 6, prior to calibration.
Figure 9:
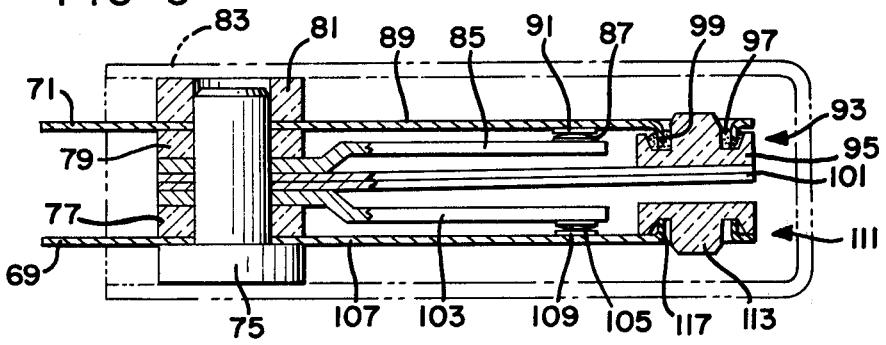
FIG. 9 is a sectional view similar to FIG. 7 illustrating calibration of a first set of contacts.
Figure 10:
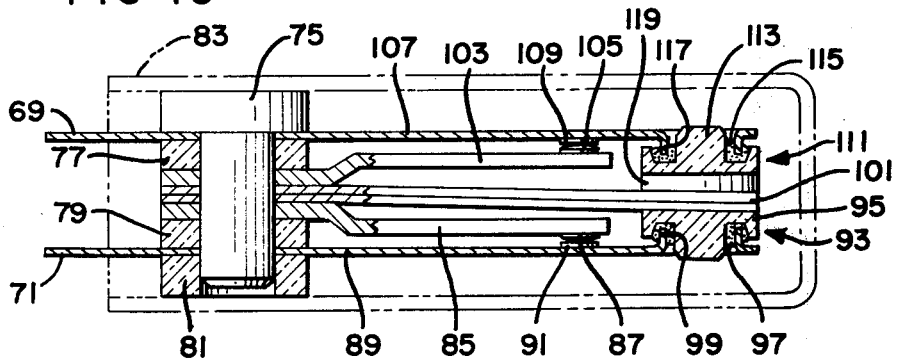
FIG. 10 is a sectional view similar to FIG. 7 illustrating calibration of a second set of contacts.

The method by which the switch is calibrated is illustrated in FIGS. 8–10. Calibration of the position of the first actuator means 93 with respect to the flexible blade 89 is accomplished in the same manner as described above with respect to the switch of FIGS. 2–5. The cavity defined by the non-conductive means 95, in this case an annular cavity, is filled with a quantity of resin 97. The switching device is then placed in an oven which is heated to a preselected temperature. The switching device is maintained in the oven at the preselected temperature until the bimetal blade 101 deflects appropriately and the resin 97 is thereafter cured. The relative position of the elements of the switching device, after curing of the resin 97, is illustrated in FIG. 9. The switching device is then inverted in the oven, as shown in FIG. 10, and a spacer element 119 is positioned between the second actuator means 111 and the bimetal blade 101. The resin 115 in the cavity defined by non-conductive means 113 then cures and bonds the actuator means 111 to the flexible contact blade 107 in the desired position with the resin 115 engaging the downward extending lip 117 of the blade 107. Curing of the resin 115 is also accomplished at the selected temperature in order to ensure that the bimetal blade 101 is appropriately deflected.

The switching device of FIGS. 6–10 may also be calibrated by a technique similar to that disclosed above, with the exception that the spacer 119 is not used. With this technique, after the resin 97 is cured, the switching device is placed in a controlled environment which is maintained at a second selected temperature, slightly above the second predetermined threshold temperature. Thereafter, the bimetal blade will be deflected upward into contact with the actuator means 111 and will hold the actuator means in the desired position for curing of the resin 115. The resin 115 may then be cured by any of a number of well-known resin curing techniques.

Numerous modifications to the embodiments disclosed may be made within the scope of the present invention. As an example, the actuator means in the switch of FIGS. 2–5 may be bonded to the bimetal blade 59 instead of bonded to the flexible blade 55. Only a minor variation in the switch structure and calibration technique would be needed, since the switch would necessarily have to be inverted during the resin curing operation in order to hold the resin within a cavity in the actuator means. Additionally, tabs extending from the bimetal blade would be required for insertion into the cavity within the actuator means.

While the methods and forms of apparatus herein described constitute preferred embodiments of the invention, it is to be understood that the invention is not limited to these precise methods and forms of apparatus, and that changes may be made therein without departing from the scope of the invention.

What is claimed is:

1. A normally closed, temperature responsive electrical switching device for providing an electrical connection between first and second electrical connectors when the temperature of the device is less than a predetermined threshold temperature, and for terminating said electrical connection between said first and second electrical connectors when the temperature of said switching device exceeds said predetermined threshold temperature, comprising:

a non-conductive mounting post assembly, a first stationary contact blade electrically connected to said first electrical connector and mounted on said mounting post assembly, a first stationary electrical switch contact, mounted on said stationary contact blade, a first flexible contact blade electrically connected to said second electrical connector and mounted on said mounting post assembly, a first movable electrical switch contact, mounted on said flexible contact blade, bimetal means, mounted on said mounting post assembly, to deflect toward said flexible contact blade in response to heating of said switching device, and first actuator means, including a non-conductive means defining a material receiving cavity, and curable material in said cavity engaging said flexible contact blade, said first actuator means interposed between said flexible contact blade and said bimetal means such that movement of said bimetal means upon heating of said switching device to a temperature above said predetermined threshold temperature results in contact between said bimetal means and said first actuator means, whereby said movable electrical contact is moved out of electrical contact with said stationary electrical contact.

2. The normally closed, temperature responsive electrical switching device of claim 1 in which the electrical connection between said first and second electrical connectors is terminated when the temperature of said electrical switching device is reduced below a second predetermined threshold temperature, comprising:

a second stationary contact blade electrically connected to said first stationary contact blade, said second stationary contact blade being mounted on said mounting post assembly, a second stationary electrical switch contact mounted on said second stationary contact blade, a second flexible contact blade electrically connected to said first electrical connector and mounted on said mounting post assembly, a second movable electrical switch contact mounted on said second flexible contact blade, and second actuator means, including a non-conductive means defining a material receiving cavity, and curable material in said cavity engaging said second flexible contact blade, said second actuator means interposed between said second flexible contact blade and said bimetal means such that movement of said bimetal means upon cooling of said switching device to a temperature below said second predetermined threshold temperature results in contact between said bimetal blade and said second actuator means, whereby said second movable electrical contact is moved out of the electrical contact with said second stationary electrical contact, thereby terminating said electrical connection between said first and second electrical connectors.

3. The temperature responsive electrical switching device of claims 1 or 2 in which said curable material is a heat curable resin.

4. An electrical switching device for maintaining an electrically conductive path between first and second electrical connectors when the switching device is below a predetermined threshold temperature and for opening said electrically conductive path when the switching device is above the predetermined threshold temperature, comprising:

electrically non-conductive switch mounting means, stationary electrical contact means mounted on said mounting means, movable electrical contact means mounted on said mounting means, bimetal means, mounted on said mounting means, for deflecting in response to an increase in temperature, and extensible actuator means, including a quantity of cured resin cured so as to engage and be secured to said movable electrical contact means, whereby said actuator means will contact said bimetal means and move said movable electrical contact means out of electrical contact with said stationary electrical contact means as said bimetal means deflects after said predetermined temperature is reached, thus opening said electrically conductive path between said first and second electrical connectors, and whereby the relative position of said actuator means and said movable electrical contact means during curing of said cured resin fixes the dimension of said actuator means in a direction extending between said bimetal means and said movable electrical contact means.

5. A method of calibrating an electrical switching device having a first stationary contact means, a first movable contact means, a bimetal means, and a first actuator means interposed between said bimetal means and said first movable contact means, comprising the steps of:

filling a cavity defined by said first actuator means with a curable material, positioning said first actuator means between said first movable contact means and said bimetal blade such that a portion of said first movable contact means extends into said cavity and is surrounded by said curable material, heating said switching device to a selected temperature whereby said bimetal means deflects to contact said first actuator means and move said first actuator means into a desired position with respect to said first movable contact means, and maintaining said switching device at said selected temperature for a sufficient time such that said curable material is cured and the relative position between said first movable contact means and said first actuator means is fixed.

6. The method of claim 5 of calibrating an electrical switching device which switching device further includes a second stationary contact means, a second movable contact means, and a second actuator means interposed between said bimetal means and said second movable contact means, further comprising the steps of:

filling a cavity defined by said second actuator means with a curable material, positioning said second actuator means between said second movable contact means and said bimetal means such that a portion of said second movable contact means extends into said cavity and is surrounded by said material therein, positioning a spacer element between said second actuator means and said bimetal means, heating said switching device to a selected temperature whereby said bimetal means in contact with said spacer element deflects and said second actuator means is moved into a desired position with respect to said second movable contact means, and maintaining said switching device at said selected temperature for a sufficient time such that said material is cured and the relative position between said first second movable contact means and said second actuator means is fixed.

7. An electrical switching device for providing an electrically conductive path between first and second electrical connectors when the switching device is below a predetermined threshold temperature and for opening the electrically conductive path when the switching device is above the predetermined threshold temperature, comprising:

electrically non-conductive mounting means, stationary contact means mounted on said mounting means and electrically connected to said first electrical connector, movable contact means mounted on said mounting means and electrically connected to said second electrical connector, said movable contact means electrically contacting said stationary contact means when said movable contact means is in a first switching position, a temperature responsive bimetal blade mounted on said mounting means on a side of said stationary contact means opposite said movable contact means, and extensible actuator means interposed between said movable contact means and said bimetal blade and including a quantity of cured material fixing the dimension of said actuator means in a direction extending between said bimetal blade and said movable contact means, whereby the movement of said bimetal blade, which occurs when said predetermined threshold temperature is exceeded, results in said actuator means moving said movable contact means into a second switching position in which it is out of contact with said stationary contact means, and whereby the relative position of said actuator means and said movable contact means during curing of said cured resin fixes said dimension of said actuator means.

8. The method of calibrating an electrical switching device having stationary contact means, movable contact means, a bimetal blade, and an extensible actuator means extending between said bimetal blade and said movable contact means, comprising:

supplying a quantity of curable material in an uncured state to a cavity defined by said extensible actuator means, heating said electrical switching device to a preselected temperature whereby said bimetal blade is deflected to a predetermined shape and said extensible actuator means is reduced in dimension between said movable contact means and said bimetal blade, and maintaining said electrical switching device at said preselected temperature until after said curable material is cured, whereby the dimension of said extensible actuator means extending in a direction between said bimetal blade and said movable contact means is fixed at a selected dimension.

* * * * *